United States Patent [19]

Levesque

[11] Patent Number: 4,832,163

[45] Date of Patent: May 23, 1989

[54] PORTABLE TABLE SYSTEM

[76] Inventor: Kathleen L. Levesque, 161 Commonwealth Ave., Warwick, R.I. 02886

[21] Appl. No.: 197,596

[22] Filed: May 23, 1988

[51] Int. Cl.[4] ..... A45F 3/00; A47B 3/10

[52] U.S. Cl. ..... 190/11; 190/12 R; 108/14; 135/20 R

[58] Field of Search ..... 190/11, 12 R, 12 A; 108/14; 135/20 R

[56] References Cited

U.S. PATENT DOCUMENTS

| | | | |
|---|---|---|---|
| 808,427 | 12/1905 | Barr | 190/11 |
| 1,839,783 | 1/1932 | Bloom | 190/11 |
| 2,190,498 | 2/1940 | Williams | 190/12 R |
| 2,277,341 | 3/1942 | Mancusi | 190/12 R |
| 3,596,866 | 8/1971 | Baker | 190/11 |

FOREIGN PATENT DOCUMENTS

| | | | |
|---|---|---|---|
| 1113569 | 12/1955 | France | 190/12 R |
| 2193087 | 2/1988 | United Kingdom | 190/11 |

*Primary Examiner*—William Price
*Attorney, Agent, or Firm*—Robert J. Doherty

[57] ABSTRACT

A portable table preferably composed of a pair of containers which cooperate in face to face relationship to form a composite table surface and further serve as a support to the pole portion of a beach umbrella.

7 Claims, 1 Drawing Sheet

PORTABLE TABLE SYSTEM

BACKGROUND AND OBJECTS OF THE INVENTION

This invention relates generally to a portable table and more particularly to a table of the type which can be used in conjunction with a pole of the type used to support beach umbrellas and the like.

As it is popular to shade oneself from the sun while picnicking or spending time at the beach, umbrellas of the type supported on an upright pole are commonplace. Such use has also given rise to the suggestion, construction, or use of table structures adapted for cooperative use with the umbrella pole. Examples of such are shown in the following U.S. Pat. Nos.: 2,190,498 issued Feb. 13, 1940; 3,295,473 issued Jan. 3, 1967; 4,584,946 issued Apr. 29, 1986; and 2,588,957 issued Mar. 11, 1952 with the latter patent referring to an unrelated container structure of which the present inventor is aware. While the table structures set forth in such patents solve some picnicking or beach-going needs, they cmpletely fail to address how additional material such as clothing, towels, lunch, books, wine, games, etc. might be brought to the rcreational site and how such material may be conveniently stored at such recreation site.

Accordingly, it would be desirable to be able to combine the function of supplying a recreational table with the function of supplying containers, i.e., baskets and the like utilized to carry such material to the recreation site. This and other objects of the present invention have been accomplished by the provision, in its simplest form, of a pair of cooperating containers which can be assembled to form a table for assembly with an umbrella-supporting pole.

More specifically, these and other objects of the present invention are accomplished by a portable table kit for use in conjunction with a pole of the type used substantially upright in supporting a beach umbrella comprising at least two containers each including a generally flat upper wall, a major upright vertically oriented wall and body portions including a lower wall cooperating with said upper surface and said major wall to define a hollow interior article containment portion and means for the individual and separate transport of said containers, said major walls each including a centrally disposed vertically oriented open-ended groove extending between said upper and lower walls, said major walls adapted for face to face engagement with said grooves aligned in an assembled position such that said upper walls form a table surface and said grooves cooperatively form a vertical passage for engaging receipt of said pole and means for holding said containers together in said assembled position, said holding means enabling said containers to be rapidly assembled into said table form and disassembled to said container form.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DETAILED DESCRIPTION OF THE INVENTION

Figure 1:
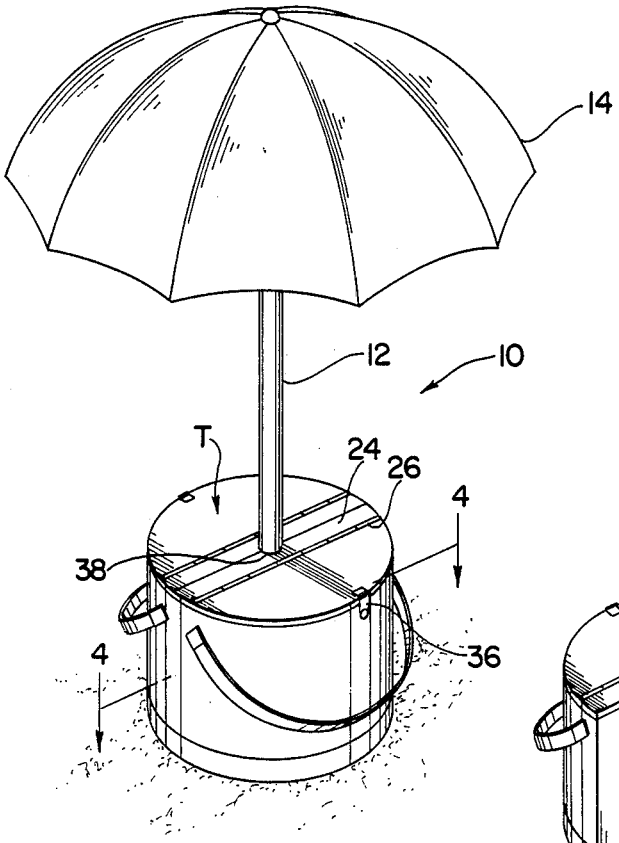
FIG. 1 is a perspective view showing the manner in which the table kit of the present invention is utilized in assembled form in conjunction with a beach umbrella.

The table kit, assemblage, unit etc. of the present invention is designated by the numeral 10 and is shown in assembled condition vis-a-vis the pole 12 of an umbrella structure 14 in the FIG. 1 drawing. It should be pointed out that although the drawing and the description to follow refers to the device primarily in conjunction with a beach umbrella, it should be apparent that the table could be equally used in conjunction with umbrellas for other recreational or even non-recreational activities or in conjunction with any upright-type pole.

Figure 3:
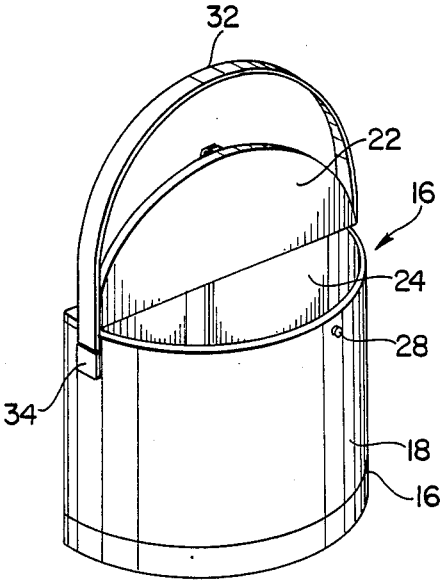
FIG. 3 is a perspective view showing one of the containers.

The table 10 preferably includes a pair of identical containers 16, although it should also be brought out that more than two containers may be assembled to form the composite table 10 and the tables 16 need not necessarily be of identical construction. Referring now to FIG. 3 particularly, each of the containers 16 includes a body 18 generally of semi-circular configuration but, as above indicated, conforming to the overall container shape and dependent on the number of containers utilized to form the composite table. Such body 18 is provided with a bottom wall 20 and a top wall 22 which in turn is hingedly connected at its inner surface with a major upright inner wall 24 with a conventional hinge 26. Thus the upper wall 22 is of generally planar, that is, flat, configuration such that when the pair of containers 16 are placed in the intended cooperating relationship with each other, the upper surfaces of the upper walls 22 and the major walls 24 form an essentially continuous useful table top T.

Preferably the main container portions 16 are formed from resinous plastic compositions as by injection or blow molding procedures and may, of course, be provided with colorful shades appropriate to their end use. The top wall 22 may be separately formed of plastic material, wood, aluminum or the like and is attached to the main container portion later, although it should be understood that any appropriate fabricating technique or suitable materials may be utilized. The body 18 is provided with an outwardly extending locking lug 28 for attachment with a keeper element 30 in turn attached to the upper wall 22. In addition, a handle, carrying element, or strap 32 is attached to opposite body 18 portions through connectors 34. Such connection is preferably close to the major wall 24 which may be formed of heavier, i.e., thicker, construction because of its contact with the pole 12 as hereinafter will be explained and its face to face contact with the walls of the other container.

Such wall 24 is also provided with a vertically oriented open-ended groove 36 which in a two-container system is of semi-circular cross-sectional configuration and extends between the upper wall or the upper surface of the inner or major wall 24 and the lower wall 20 for uninterrupted receipt of a portion of a pole 12. It should also be pointed out that normally the groove 36 will be molded in form but that the wall could be formed without such groove and the groove formed therein afterwards—the important feature being the presence of the groove of a cross-sectional configuration which matches a partial cross-sectional configuration of the pole 12. Normally, the groove 36 configuration is semi-circular such that two grooves disposed in face to face relationship will form a circular opening 38 for the pole 12.

Figure 2:
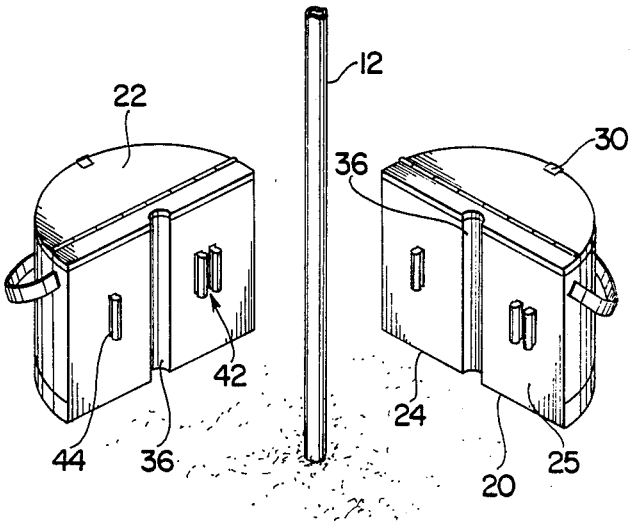
FIG. 2 is a partially exploded perspective view showing the manner in which the container portions of the table are assembled.
Figure 4:
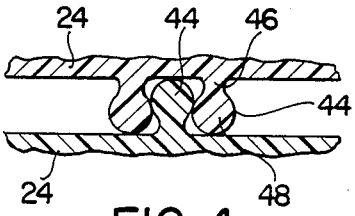
FIG. 4 is an enlarged sectional view taken along the line 4—4 of FIG. 1.

In order to hold the containers 16 together in the assembled position as shown in FIG. 1, holding means 42 are depicted in the preferred FIG. 2 embodiment as a series of vertically lugs 44 outwardly projecting from the outer face 25 of the upright wall 24. On one side of the wall 25, that is, to the right of the groove 36, a pair of such lugs in laterally spaced relationship to each other is positioned while at the other side of the face 25, a single lug is positioned. Accordingly when two identical containers 16 provided with such lugs are turned in face to face position such that the grooves 36 cooperatively form a circular passage, the single lugs will line up between the pairs of lugs such that a snap fit engagement therebetween may take place. Such engagement is shown particularly by FIG. 4 wherein the shape of the lugs 44 is shown as including a base or stem portion 46 and a somewhat enlarged head portion 48. Of course, any cooperating shape that enables frictional connection could be provided to the respective lugs. In this manner, the containers may be engaged with each other to form the assembled table unit 10 of the present invention. The table unit may also be readily disassembled such that the containers may be individually used for containment functions. It should also be brought out that such arrangement facilitates transporting articles to the recreational site through the convenient container use and then utilizing such containers for another useful purpose—that of a table which ordinarily might have to be separately supplied. Instead of being something to be disposed of temporarily, the assembled table 10 furthermore provides a surface for cards, drinks, etc. and serves as a useful support for the pole 12 such that the umbrella 14 is less likely to be undesirably tipped or blown away.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A portable table kit for use in conjunction with a pole of the type used substantially upright in supporting a beach umbrella comprising at least two containers each including a generally flat upper wall, a major upright vertically oriented wall and body portions including a lower wall cooperating with said upper wall and said major wall to define a hollow interior article containment portion and means for the individual and separate transport of said containers, said major walls each including a centrally disposed vertically oriented open-ended groove extending between said upper and lower walls, said major walls adapted for face to face engagement with said grooves aligned in an assembled position such that said upper walls form a table surface and said grooves cooperatively form a vertical passage for engaging receipt of said pole and means for holding said containers together in said assembled position, said holding means enabling said containers to be rapidly assembled into said table form and disassembled to said container form.

2. The table of claim 1, said holding means comprising mutually engageable means positioned on the major wall of said containers.

3. The table of claim 2, there being a pair of said containers, said holding means being vertically oriented cooperating snap fit engaging lugs outwardly extending from said major walls, one of said major walls including a pair of laterally disposed lugs and the other major wall having a single lug for engagement between said lug pair.

4. The table of claim 1, said major walls being of a greater thickness than the other walls.

5. The table of claim 1, said grooves being partially circular in cross section so as to cooperatively form a circular passage for receipt of the pole.

6. The table of claim 1, there being a pair of containers, said containers being essentially identical to each other.

7. The table of claim 6, said means for the individual and separate transport of said containers being a carrying handle and means for holding said top wall in a closed position.

* * * * *